United States Patent [19]

Brandt

[11] Patent Number: 4,553,068

[45] Date of Patent: Nov. 12, 1985

[54] HIGH POWER MILLIMETER-WAVE SOURCE

[75] Inventor: Howard E. Brandt, Silver Spring, Md.

[73] Assignee: The United States of America as represented by the Secretary of the Army, Washington, D.C.

[21] Appl. No.: 545,571

[22] Filed: Oct. 26, 1983

[51] Int. Cl.[4] ..... H01J 25/00

[52] U.S. Cl. ..... 315/4; 315/5; 315/39

[58] Field of Search ..... 315/3, 4, 5, 39

[56] References Cited

U.S. PATENT DOCUMENTS

| | | | |
|---|---|---|---|
| 3,489,943 | 1/1970 | Denholm | 315/5 |
| 4,150,340 | 4/1979 | Kapetanakos et al. | 315/3 |
| 4,213,073 | 7/1980 | Mahaffey et al. | 328/233 |
| 4,345,220 | 8/1982 | Sullivan | 315/39 |
| 4,453,108 | 6/1984 | Freeman, Jr. | 315/5 |
| 4,459,511 | 7/1984 | Alexeff | 315/4 |
| 4,491,765 | 1/1985 | Manheimer et al. | 315/5 |

*Primary Examiner*—Saxfield Chatmon

*Attorney, Agent, or Firm*—Saul Elbaum; Alan J. Kennedy; Anthony T. Lane

[57] ABSTRACT

A simple method and apparatus are disclosed for producing high power gigawatt level millimeter radiation from an intensely oscillating relativistic turbulent electron plasma created in and beyond the gap of a high voltage diode configuration. The diode is comprised of an explosive cathode emitter and an extended anode structure connected to the inner and outer conductors, respectively, of a high voltage pulse line under conditions of space charge saturation. The gap spacing and voltage determine the dominate mode of the turbulent longitudinal waves which are directly converted into free transverse waves polarized parallel to the electron beam. A simple coaxial reflector-antenna system is also utilized to direct and focus the resultant radiation.

20 Claims, 5 Drawing Figures

HIGH POWER MILLIMETER-WAVE SOURCE

STATEMENT OF GOVERNMENT INTEREST

The invention described herein may be manufactured and used by or for the Government for governmental purposes without the payment of any royalty thereon.

BACKGROUND OF THE INVENTION

This invention relates to a microwave generator called a turbutron and more particularly to an apparatus and method for producing a high power gigawatt level source of millimeter-wave radiation.

There are available in the prior art other types of high power microwave sources that utilize an electron beam as a source of free energy with a resonant structure to convert the electron beam free energy to oscillatory electromagnetic energy. There are also devices including reflex triodes, reflex diodes, and vircators which utilize the concept of a virtual cathode to generate microwaves. Each of these devices has a boundary or virtual cathode beyond the primary anode plane through which relatively few electrons penetrate and from which most electrons are reflected.

The reflex triode has been demonstrated to be an impressive high power source of microwave radiation. In particular ten nanosecond bursts of gigawatt level microwave radiation were achieved in X-band at 10 GHz. The work is documented in the Harry Diamond Laboratories technical report HDL-TR-1917, dated Aug., 1980 and entitled, Gigawatt Microwave Emission from a Relativistic Reflex Triode, by H. E. Brandt, A. Bromborsky, H. B. Bruns, R. A. Kehs, and G. P. Lasche. In the reflex triode the cathode and plate are at ground potential and the anodal grid is at a high megavolt level voltage. An intensely oscillating relativistic electron plasma is created in and beyond the accelerating gap and is the source of microwaves. Most of the electrons are reflected at the virtual cathode. Diode and triode configurations do not differ significantly in their dynamical and radiation characteristics. In particular, a diode configuration may be modeled analogously to the triode, but with the plate and grid at equal positive megavolt potential with respect to the cathode. In the diode a virtual cathode forms at nearly the same position as for the triode. In both devices the electrons are concentrated within approximately 1 cm of both sides of the grid for a 1 cm gap, and the dominant spectral characteristics are comparable. Both the level and the frequency content of the power spectral densities are very similar. In the preferred embodiment the turbutron has such a diode configuration but with a 3 mm gap instead of a 1 cm gap in order to increase the dominant frequency from 10 GHz to the atmospheric window at 35 GHz. The earlier success with the reflex triode in both predicting and obtaining gigawatt power levels at 10 GHz, together with the fact that diode and triode configurations have comparable microwave characteristics, were the bases for the turbutron concept.

The vircator is essentially a reflex diode in which the reflexing electrons are removed in some way, for example, by shaping the confining magnetic field or employing a slotted anode. The remaining electrons are concentrated in a potential well localized at the virtual cathode and oscillating in a single mode. The operation of the vircator requires the frequency of the oscillating virtual cathode to be the same as that of a mode of an axial waveguide/drift tube so as to be at resonance. The turbutron, however, produces gigawatt radiation without the requirements of a tuned axial drift tube, or magnetic focusing of the beam, and without wasting a significant fraction of the electron beam. The turbutron is not as complicated as the vircator nor does it require the precision tuning of the vircator. In addition the turbutron diode configuration has allowed for the increase of the dominant frequency to the atmospheric window at 35 GHz which is a significant improvement over high power reflex triodes and diodes which operate in the 10 GHz range. These features can be particularly important in military applications.

SUMMARY OF THE INVENTION

The present invention discloses a high power millimeter-wave source comprised of an intensely oscillating relativistic turbulent electron plasma created in and beyond the gap of a high voltage diode configuration. The diode utilizes an explosive cathode emitter and an extended anode structure connected to the inner and outer conductors, respectively, of a high voltage pulse line under conditions of space charge saturation. The gap spacing and the applied voltage determine the dominant mode of the turbulent longitudinal waves which are directly converted into free transverse waves emitted perpendicular and polarized parallel to the electron beam. The applied voltage waveform, cathode diameter, total scalar potential, nonlinear bunching mechanisms, and virtual cathode dynamics also effect the spectral characteristics of the radiation. A simple coaxial reflector-antenna system is utilized to directly receive and focus the resultant radiation. For a turbutron with a megavolt pulse across a 3 mm gap and without a resonator, the immediate attainability of gigawatt power levels at the 35 GHz atmospheric window is achievable.

It is one object of the present invention, therefore, to provide a new high power source of millimeter wave radiation capable of producing gigawatt power levels at the 35 GHz atmospheric window.

Another object of the present invention is to simply provide a high power microwave radiation source which feeds directly into a reflector-antenna without the necessity of a tuned waveguide/drift tube or magnetic focusing.

These and other objects, advantages and features of the invention will become apparent after considering the following detailed description of the invention taken in conjunction with the accompanying drawings.

DESCRIPTION OF THE PREFERRED EMBODIMENT

Figure 1:
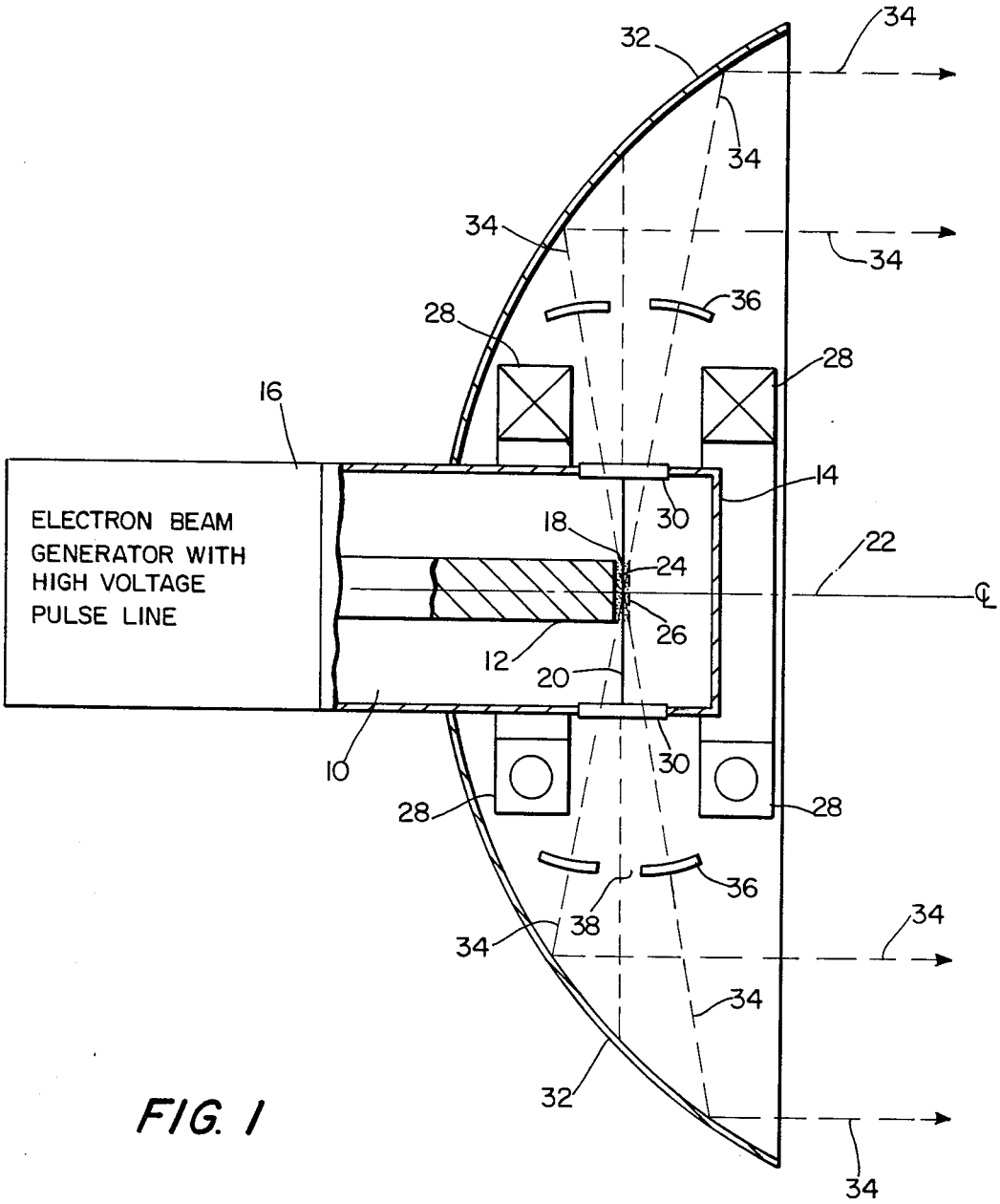
FIG. 1 is an overall view of the turbutron according to the present invention.
Figure 1A:
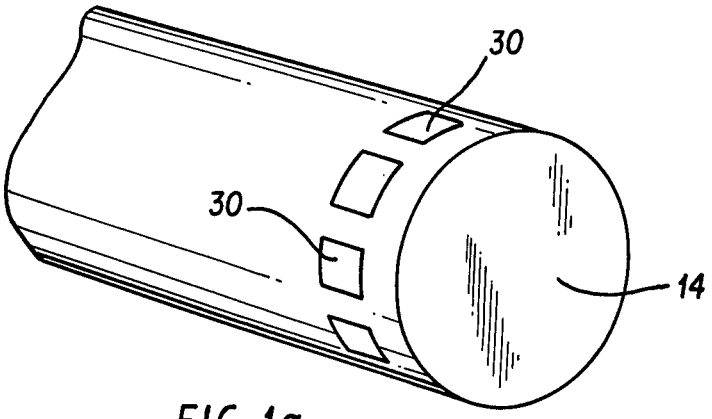
FIG. 1*a* is a view of the cylindrical anode structure showing the placement of the microwave windows about its cylindrical surface.

Referring now to FIG. 1 of the drawings, there is shown a high power microwave generator apparatus called a turbutron to emphasize the fact that the source of the radiation is in the turbulent state of the relativistic electron plasma. The diode configuration 10 of the turbutron is comprised of a cylindrical-shaped, explosive cathode emitter 12, which is made of carbon. The other element of the diode 10 is an extended cylindrical anode structure 14 which is typically made of steel. The diode 10 is connected to a megavolt voltage pulse line 16 of an electron beam generator which will produce a one megavolt voltage pulse that will traverse down the pulse line to the cathode emitter 12 along diode axis 22. The anode structure 14 acts to create an equipotential surface which is at ground relative to the cathode 12 which is at negative megavolt potential. The cathode 12 is also approximately 5.1 cm diameter which produces a 5.1 cm diameter solid cylindrical electron beam and also results in constructive interference at 35 GHz. A thin 6 micron circular aluminized Mylar foil forms a primary anode element, 20, that is positioned within the extended anode 14 at an approximate distance of 3 mm from the flat circular end of the cathode emitter 12. However the primary anode 20 may also be a wire grid or a metal foil with a circular hole that would enable repetitive operation. The internal region of the diode configuration 10 is evacuated. A vacuum on the order of $10^{-4}$ TORR is typical for this invention. Microwave windows 30 are positioned about the periphery of the cylindrical wall of the extended anode structure 14 as is illustrated in FIG. 1*a*. The microwave windows 30 are made of Lucite or other similar material that is transparent to electromagnetic radiation. The microwave windows must be vacuum sealed and must be greater than 3 mm wide, or larger than the wavelength of the microwave radiation to be nondiffractive.

Figure 2:
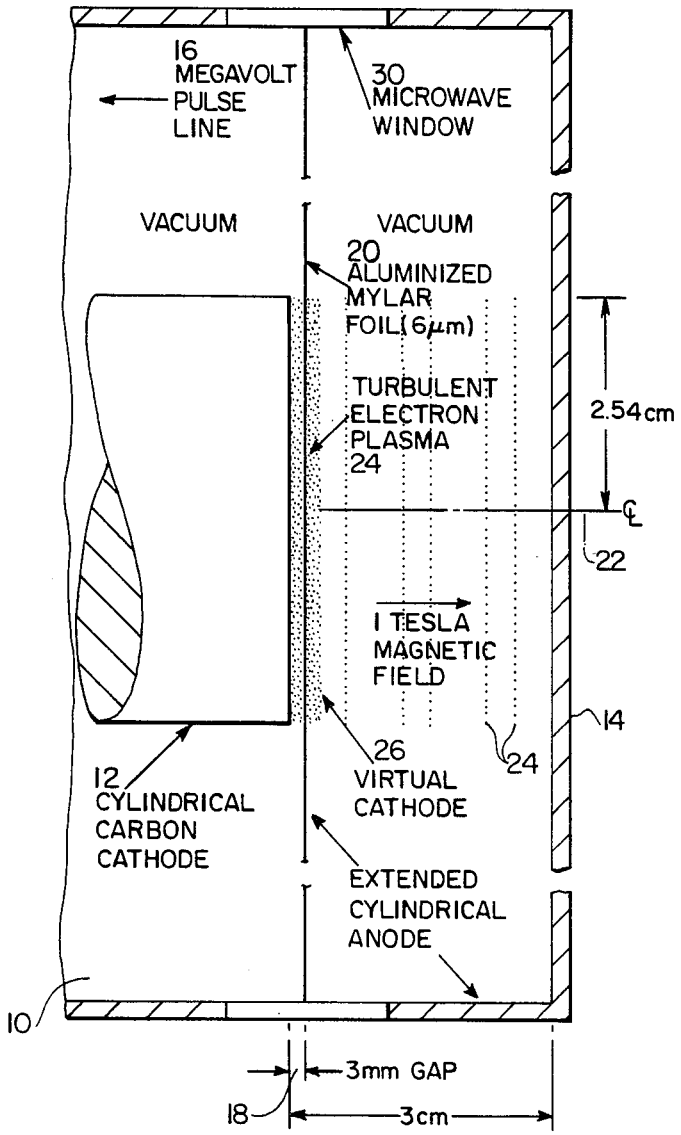
FIG. 2 shows a detailed view of the turbutron diode configuration.

Referring now to FIG. 2 it is shown that diode 10 has a cathode-anode space gap 18 which was chosen to be 3 mm in order to produce gigawatt power levels at a dominant frequency of 35 GHz at the atmospheric window. A pair of annular magnet coils 28 (FIG. 1) are positioned external and coaxially to diode 10. The magnet 28 is a Helmholtz magnet coil operating in the 1 Tesla range and consists of two annular magnet coils located on either side of microwave windows 30, and produces a magnetic field parallel to diode axis 22 to confine the electron plasma radially. A virtual cathode 26, which is an imaginary boundary beyond which few electrons are allowed to pass, is formed along a plane that is at a distance from emitter cathode 12 that is approximately twice the cathode-anode gap 18. In this embodiment, the virtual cathode 26 is formed at a distance of approximately 6 mm from the flat end of emitter cathode 12. The turbulent electron plasma 24 is formed in the region of diode 10 bounded by the flat end of the emitter cathode 12 and virtual cathode 26. A microwave reflector-antenna 32 is located coaxially with the cylindrical anode structure 14 and external to magnet coils 28. Antenna 32 reflects microwaves 34 out parallel and external to diode axis 22 and is shaped in a curved, dishlike manner to produce a prescribed gain pattern.

In an alternate embodiment of this invention, a quasi-optical mirror resonator 36 is positioned coaxially with reflector antenna 32 and turbulent electron plasma 24. The mirror resonator 36 partially reflects radiation 34 back into the electron plasma 24 and partially transmits radiation 34, through openings 38 in the mirror resonator 36, to reflector antenna 32. Microwave amplification is produced by autoresonant interaction of the primary mode of the electron plasma with its own radiation field.

In operation, when the turbutron is fired, a voltage pulse of approximately 1 Megavolt will move down pulse line 16 and across the cathode-anode gap 18, explosively pulling tens of kA average current of electrons from emitter cathode 12. Gap 18 and the region beyond up to the virtual cathode 26 will fill with a relativistic turbulent electron plasma 24 having a broad turbulent spectrum of modes of oscillation but peaking at 35 GHz and thereby producing tens of nanoseconds of pulsed high power millimeter waves 34 radiating out radially and polarized parallel to the axis 22 of the turbutron. The waves 34 will pass through microwave windows 30 and will be reflected and focused by microwave reflector/antenna 32.

THE TURBULENT ELECTRON PLASMA

At the onset of the voltage pulse across the 3 mm cathode-anode gap, electrons are explosively pulled out of the cathode plasma and begin to fill up the diode region. As may be seen from FIG. 3, during the first 60 picoseconds there is smooth flow of the electrons toward the far wall of the anode at approximately 0.9 the velocity of light. The initial electron density wave has a density in the leading edge of approximately one coulomb per cubic meter. After approximately 60 picoseconds one sees the onset of space charge limiting, the formation of a virtual cathode and the onset of the turbulent state of the electron plasma between the emission and virtual cathodes. The virtual cathode oscillates both in position and electrical potential. At the virtual cathode there occurs a shocklike discontinuity in the total electric field. Some relativistic electron density wave fronts penetrate the virtual cathode and move at near constant velocity toward the end wall of the extended anode structure with energy much greater than the 1 MV accelerating potential.

Figure 3:
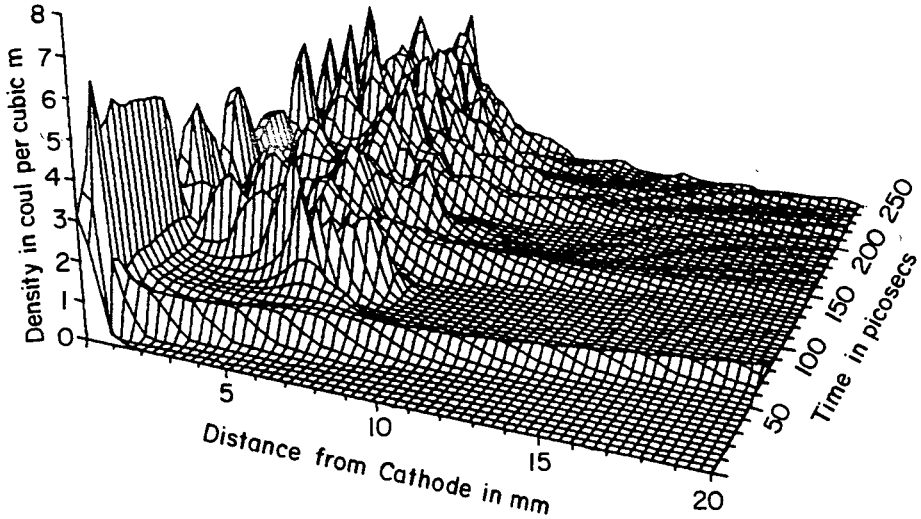
FIG. 3 is a plot of the electron charge density of the turbulent electron plasma in the turbutron for the preferred embodiment as a function of distance from the emitter cathode in millimeters and the time in picoseconds.

Following the formation of the virtual cathode the total space charge saturates with oscillations about the time average. As can be seen in FIG. 3 the spectral distribution of the electron plasma is very broadband with many modes highly excited. This is the turbulent state of the pure electron plasma. Electrons entering the gap with favorable phases relative to a given frequency component of the resultant space charge fields give up energy to the fields and remain in the diode region while those with unfavorable phases gain energy from the fields and are ejected from the turbutron. Favorably phased electrons tend to be grouped together spatially since they enter about the same time. Space-charge limiting periodically limits the subsequent entrance of electrons at the emission cathode as may be seen from the quasiperiodic peaks of approximately 5 coul/$m^3$ in the electron density at the cathode. It is noteworthy that the frequency of this quasiperiodic space charge limiting is near the dominant frequency of emission at 35 GHz. The primary mode of oscillation of the virtual cathode is also near the dominant emission frequency. The phase selection mechanism gives rise to electron bunching. While the electron bunches oscillate back and forth about the anode, they also interact with one another, scattering, and ejecting and capturing electrons from one another and thereby being depleted and growing in size. Bunches are born and bunches die. This is the regime of strong turbulence of the relativistic electron plasma.

In the turbutron the bulk of the electrons are spread out turbulently between the emission and virtual cathodes, and are not concentrated at the virtual cathode as in the vircator. The virtual cathode is merely one, albeit very visable, feature of the nonlinear state of the electron plasma in the turbutron. It is to be stressed that many other characteristics of the plasma such as its dynamical spectral distribution, coherence characteristics, and relative phases of electron bunches are also important in determining the properties of the radiated power spectrum.

The broadband dynamical spectrum of the turbulent electron plasma with the associated high frequency oscillations of the transient electron bunches result in a broadband microwave spectrum. Noteworthy is the fact that the total power radiated in the prototype turbutron is approximately one GW/sr with significant broadband emission also in S, C, X, Ku, and K-band in addition to the dominant millimeter-wave band shown in FIG. 3. The turbulent longitudinal waves are directly converted into free transverse waves polarized parallel to the turbutron axis.

SPECTRAL DESIGN

Figure 4:
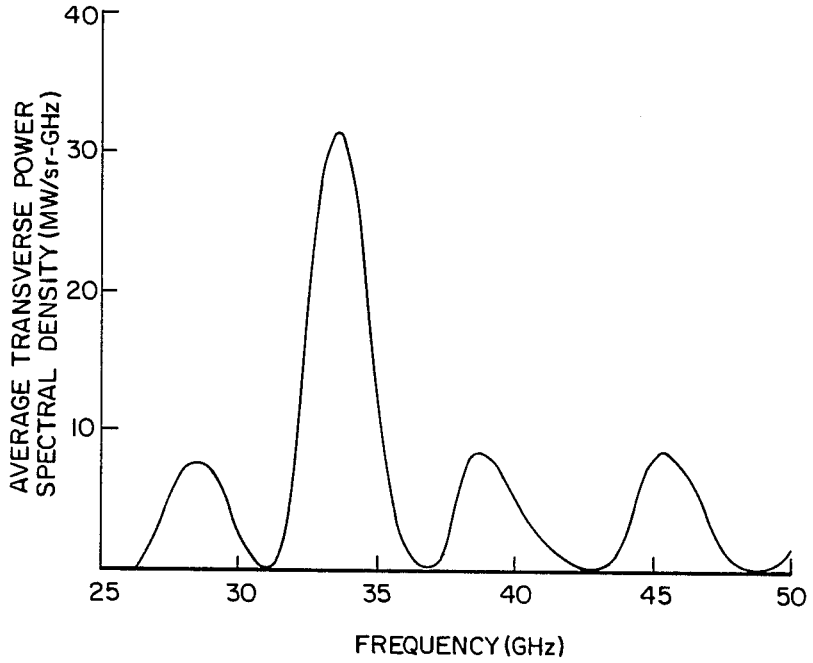
FIG. 4 is a plot of the turbutron's average transverse power spectral density for the preferred design or embodiment.

For the solid cylindrical beam in the turbutron the interference form factor is the same as that for the reflex triode. Zeros in the spectrum occur for frequency f such that $J_1(2\pi fR/c)$ in the form factor is vanishing, where $J_1$ is a first-order Bessel function of the first kind, R is the beam radius, and c is the speed of light. In the case of the turbutron with a 5.1 cm beam diameter, this factor determines the zeros at 25, 31, 37, 43 and 49 GHz in FIG. 4. By varying the radius, the transverse power spectral density will vary as $[RJ_1(2\pi fR/c)]^2$ and the zeros resulting from destructive interference can be moved accordingly. Of course, by changing the beam geometry, making it hollow, for example, the expression for the form factor and the associated spectral modulation can be changed also.

The dominant frequency can be decreased by increasing the gap. Thus, for example, the same turbutron with a 1 cm gap will produce a gigawatt in X-band at 10 GHz with spectral characteristics very similar to those of the reflex triode. Gaps smaller than 3 mm are limited by gap closure for a 1 MV gap voltage. There is a much weaker but more complicated dependence of the location of the various spectral peaks on the gap voltage.

The power may be significantly increased by increasing the gap voltage. Of course, to maintain the dominant frequency near 35 GHz the gap must be increased also. Thus, for example, a voltage of 3 MV across a 4.4 mm gap will produce 150 MW/sr-GHz near 35 GHz over a band of approximately 3 GHz width and perpendicular to the beam. This is a 5-fold increase in power over the prototype. The power densities at 9.5, 16, 22 and 27 GHz are also near this level. For the 3 MV gap voltage the total power radiated in all bands is approximately 4 GW/sr. Nominally, a several GW peak power millimeter-wave source at 35 GHz should be obtainable from a turbutron with 3 MV across a 4.4 mm gap. At lower frequencies, for example in X-band, it is likely that tens of GW peak power can be obtained from a turbutron with approximately 3 MV across an approximate 1 cm gap. At frequencies above 35 GHz it is possible that the turbutron can also be a GW level source. For example, with 3 MV across a 3.4 mm gap a turbutron will produce an average transverse power spectral density near 46 GHz of 330 MW/sr-GHz.

Many changes and modifications of the above-desired embodiments can be carried out without departing from the scope of the invention. That scope, therefore, is intended to be limited only by the scope of the appended claims to follow.

What is claimed is:

1. A device called a turbutron for producing millimeter wave pulses in the gigawatt power range, comprising in combination:

a high voltage diode configuration which is maintained under vacuum and comprised of an explosive, cylindrical cathode; an extended cylindrical anode structure and a gap spacing between said anode and cathode;

a megavolt coaxial pulse line for producing a beam of electrons under conditions of charge saturation, said beam of electrons being explosively emitted from said cathode to create an intensely oscillating relativistic turbulent electron plasma in and beyond said gap of said diode configuration, thereby producing pulsed high power millimeter waves radiating out radially and polarized parallel to the axis of said electron beam;

a plurality of microwave windows located transverse to the diode configuration gap at the outer cylindrical wall of said anode structure;

annular magnet coils located external and coaxial to said diode configuration that produce a strong uniform axial magnetic field in order to restrict the electrons in said turbulent electron plasma to pure longitudinal motion along said magnetic field;

wherein said relativistic turbulent electron plasma is predominately confined between said emission cathode and a virtual cathode and confined radially about said electron beam axis; and wherein said virtual cathode is an imaginary boundary beyond which few electrons pass and is oscillating both in electrical potential and position, the latter centered at a distance which is approximately twice the cathode anode gap.

2. The device of claim 1 wherein said millimeter waves have a pulse length in the range ten nanoseconds and a frequency of 35 GHz enabling propagation through the atmosphere.

3. The device of claim 1 wherein said plasma has a broad turbulent spectrum of longitudinal modes of oscillation which peak at 35 GHz and are directly converted into free transverse millimeter waves.

4. The device of claim 1 wherein the cathode electrode is made of carbon.

5. The device of claim 1 wherein said anode structure is comprised of a primary anode surface made of aluminized Mylar foil located 3 millimeters axially from the end of said cylindrical cathode, and the remaining surface of said anode structure is made of steel and is sufficiently distant from the cathode to avoid cavity resonance and surface breakdown.

6. The device of claim 1 wherein said diode configuration is maintained at a vacuum of $10^{-4}$ torr.

7. The device of claim 1 wherein the microwave windows are made of a microwave transparent material such as Lucite.

8. The device of claim 1 wherein a microwave reflector antenna is located coaxially with said cylindrical anode structure and externally to said magnet coils to reflect microwaves out parallel and external to said diode axis and wherein said antenna is shaped in a curved dishlike manner to produce a prescribed gain pattern.

9. The device of claim 8 wherein a quasioptical mirror resonator having apertures about its periphery is located coaxially between said reflector antenna and the axis of said turbulent electron plasma to partially reflect radiation back into said plasma and to partially transmit said radiation to said antenna through said apertures thereby producing microwave amplification.

10. The device of claim 9 wherein said apertures are non defractive.

11. The device of claim 1 wherein said anode structure is comprised of a primary anode surface made of a strong wire grid.

12. The device of claim 1 wherein said anode structure is comprised of a metallic primary anode surface having a circular aperture therein, said aperture having a diameter that is larger than the diameter of said electron beam.

13. The device of claim 1 wherein said magnet coil is a Helmholtz magnet coil that operates in the 1 Tesla range; said magnet being located external and coaxially to the diode, wherein said magnet coil is comprised of two annular magnet coils located on either side of the microwave windows and produces a magnetic field parallel to the diode axis.

14. A device called a turbutron for producing millimeter wave pulses in the gigawatt power range, comprising in combination:

a high voltage diode configuration, which is maintained at a vacuum, comprised of an explosive cylindrical cathode, an extended cylindrical anode structure and a gap spacing of near 3 mm between said anode and end of said cathode;

a megavolt coaxial pulse line for producing a beam of electrons under conditions of charge saturation, said beam of electrons being explosively emitted from said cathode to create an intensely oscillating relativistic turbulent electron plasma in and beyond said gap of said diode configuration, thereby producing pulsed high power millimeter waves radiating out radially and polarized parallel to the axis of said electron beam, said millimeter waves having a pulse length in the range of 10 nanoseconds and a dominant frequency of 35 gigahertz enabling propagation through the atmosphere;

wherein said relativistic turbulent electron plasma is predominantly confined between said emission cathode and a virtual cathode, said plasma having a broad turbulent spectrum of longitudinal modes of oscillation however peaking at 35 gigahertz and being directly converted into free transverse millimeter waves;

wherein said anode structure includes a circular primary anode surface made of aluminized Mylar foil of near micron thickness, located 3 millimeters axially from the end of said emission cathode and joined to the cylindrical wall of said anode structure, wherein the wall of said anode structure is made of steel and is sufficiently distant from said emitter cathode to avoid wall breakdown and cavity resonance;

a plurality of microwave windows located transverse to said gap of said diode configuration at the outer cylindrical wall of said anode structure;

annular magnet coils located external and coaxial to said diode configuration to aid in confining said turbulent electron plasma radially along the diode axis; and a microwave reflector/antenna located coaxially with said cylindrical anode structure and externally to said magnet coils to reflect said microwaves out parallel and external to said diode axis and wherein said antenna is shaped in a curved, dishlike manner to produce a prescribed gain pattern.

15. A device called a turbutron for producing millimeter wave pulses in the gigawatt power range, comprising in combination:

a high voltage diode configuration, which is maintained at a vacuum, comprised of an explosive cylindrical cathode, an extended cylindrical anode structure and a gap spacing of near 3 mm between said anode and end of said cathode;

a megavolt coaxial pulse line having its center and outer conductors connected to said cathode and anode respectively, for producing a beam of electrons under conditions of charge saturation, said beam of electrons being explosively emitted from said cathode to create an intensely oscillating relativistic turbulent electron plasma in and beyond said gap of said diode configuration, thereby producing pulsed high power millimeter waves radiating out radially and polarized parallel to the axis of said electron beam, said millimeter waves having a pulse length in the range of 10 nanoseconds and a dominant frequency of 35 gigahertz enabling propagation through the atmosphere;

wherein said relativistic turbulent electron plasma is predominantly confined between said emission cathode and a virtual cathode, said plasma having a broad turbulent spectrum of longitudinal modes of oscillation, however peaking at 35 gigahertz and being directly converted into free transverse millimeter waves;

wherein said anode structure includes a circular primary anode surface made of aluminized Mylar foil of near micron thickness, located 3 millimeters axially from the end of said emission cathode and joined to the cylindrical wall of said anode structure, wherein the wall of said anode structure is made of steel and is sufficiently distant from said emitter cathode to avoid wall breakdown and cavity resonance;

a plurality of microwave windows located transverse to said gap of said diode configuration at the outer cylindrical wall of said anode structure;

annular magnet coils located external and coaxial to said diode configuration that produce a strong uniform axial magnetic field of at least one tesla in order to restrict the electrons in said turbulent electron plasma to pure longitudinal motion along said magnetic field; and a microwave reflector/antenna located coaxially with said cylindrical anode structure and externally to said magnet coils to reflect said microwaves out parallel and external to said diode axis and wherein said antenna is shaped in a curved, dishlike manner to produce a prescribed gain pattern.

16. The device of claim 15 wherein a quasioptical mirror resonator having apertures about its periphery is located coaxially between said reflector antenna and the axis of the turbutron to partially reflect radiation back so that the reflected radiation is resonantly coupled to the primary mode of said turbulent electron plasma, and to partially transmit said radiation to said antenna through said apertures thereby producing microwave amplification.

17. The device of claim 15 wherein said anode structure is comprised of a primary anode surface made of a strong wire grid.

18. The device of claim 15 wherein said anode structure is comprised of a metallic primary anode surface having a circular aperture therein, said aperture having a diameter that is larger than the diameter of said electron beam.

19. The device of claim 15 wherein said cylindrical cathode is 5.1 centimeters in diameter.

20. The device of claim 15 wherein said vacuum is of the order of $10^{-4}$ Torr.

* * * * *